US005441322A

United States Patent [19]

Jobmann et al.

[11] Patent Number: 5,441,322

[45] Date of Patent: Aug. 15, 1995

[54] APPARATUS FOR LIFTING DRUMS

[75] Inventors: Wolfgang Jobmann; Uwe Stier, both of Hamburg, Germany; Michael D. Naugle, Seffner, Fla.

[73] Assignee: Wolfgang Jobmann Florida, Inc., Seffner, Fla.

[21] Appl. No.: 279,488

[22] Filed: Jul. 22, 1994

[51] Int. Cl.[6] ..... B66C 1/66

[52] U.S. Cl. ..... 294/90; 294/103.1; 294/119.1

[58] Field of Search ..... 294/16, 34, 67.3, 67.33, 294/81.21, 81.54, 81.62, 82.13, 90, 103.1, 119.1; 414/450, 607, 608, 621, 626

[56] References Cited

U.S. PATENT DOCUMENTS

| | | | |
|---|---|---|---|
| 1,819,390 | 8/1931 | Seager | 294/119.1 X |
| 2,515,918 | 7/1950 | Weeks et al. | 294/67.33 |
| 2,789,858 | 4/1957 | Kughler | 294/119.1 X |
| 3,352,591 | 11/1967 | Casey | 294/90 X |
| 4,018,468 | 4/1977 | Lundquist | 294/90 X |
| 4,135,655 | 1/1979 | Brown | 294/103.1 X |
| 4,272,220 | 6/1981 | Garcia | 414/607 |
| 4,951,990 | 8/1990 | Hollan et al. | 294/119.1 |
| 5,171,053 | 12/1992 | Rouleau | 294/106 |
| 5,236,298 | 8/1993 | Lehman | 414/607 |

FOREIGN PATENT DOCUMENTS

| | | | |
|---|---|---|---|
| 548380 | 11/1959 | Belgium | 294/119.1 |
| 109996 | 8/1968 | Denmark | 294/103.1 |
| 2576007 | 7/1986 | France | 294/90 |
| 8701885 | 3/1989 | Netherlands | 294/67.33 |
| 165373 | 11/1958 | Sweden | 294/119.1 |

*Primary Examiner*—Johnny D. Cherry
*Attorney, Agent, or Firm*—Brian Steinberger

[57] ABSTRACT

Apparatus for lifting storage drums and the like is disclosed. A preferred embodiment includes two tubes telescopically inserted within one another whose opposing ends contain clamps to grip about indented edge ridges of a drum to be lifted. A stretched spring pulls the clamps continuously towards one another. A rope or chain is used to lift both the tubes and the drum. A lifting arrangement has the one embodiment able to lift and lower an individual drum to side-by-side arrangements with other drums.

6 Claims, 2 Drawing Sheets

Fig. 3
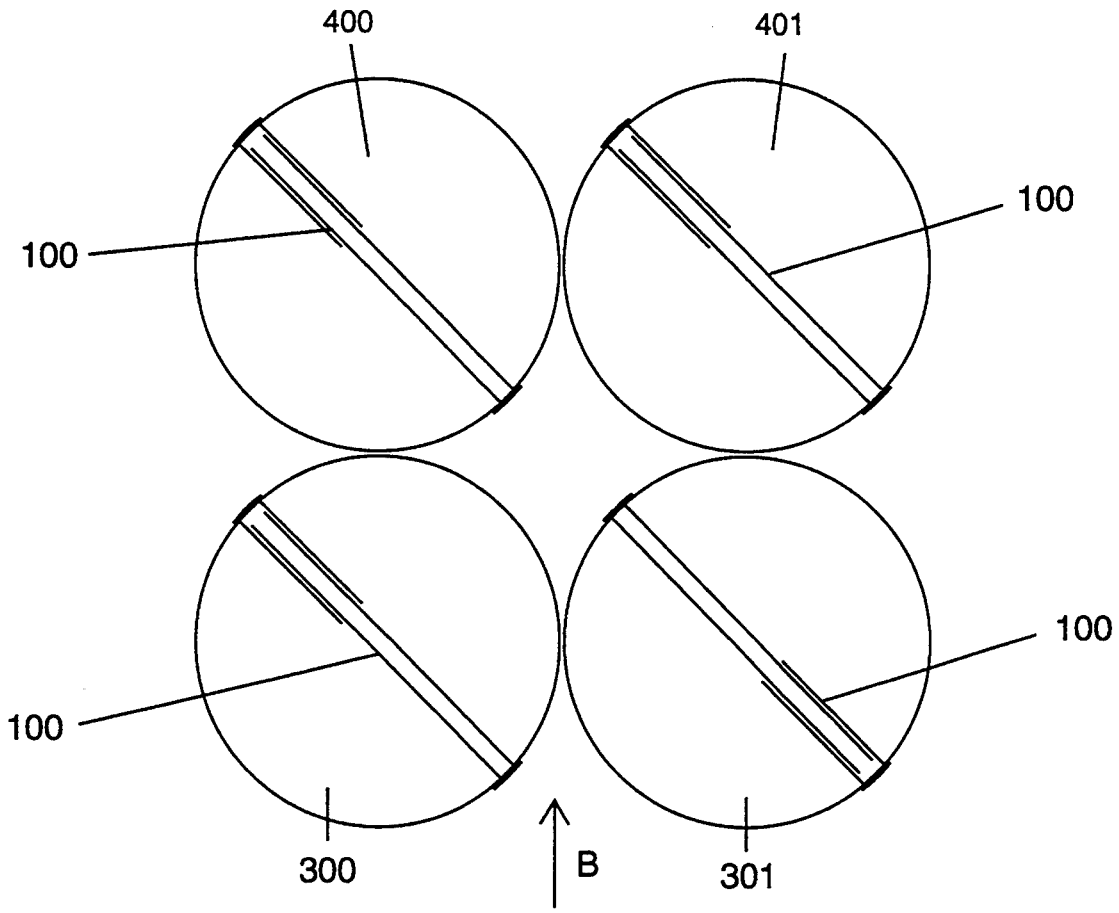
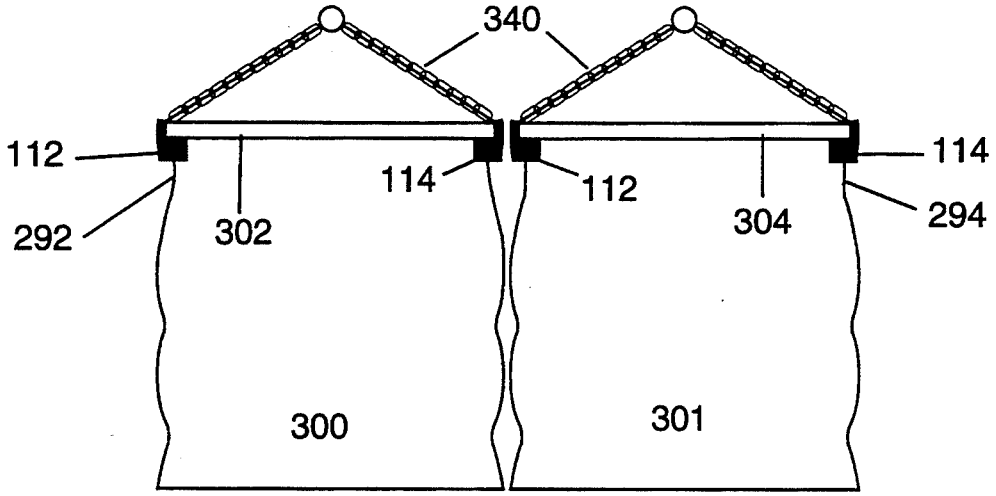
Fig. 4

APPARATUS FOR LIFTING DRUMS

This invention relates to lifting devices, and in particular to apparatus for lifting plural drums simultaneously. This invention relates to the application Ser. No. 08/279,502 entitled Conical Drum Apparatus, filed on Jun. 2, 1994 by the same applicants thereof, now U.S. Pat. No. 5,390,795, which is incorporated by reference.

BACKGROUND AND PRIOR ART

Standard lifting devices for 55 gallon drums, including metal and plastic drums that are used for storing products such as dry goods and liquids, have numerous problems and limitations. For example, these prior art devices are designed for domestic warehouse applications and are not intended nor suitable for stevedoring operations aboard merchant cargo ships. Individual lifting mechanisms are often limited to fork lift type attachments that grip about the tops of single cylindrical drums. See U.S. Pat. No. 5,236,298 to Lehman which only has the capability of lifting one drum at a time with a fork lift. Devices such as the Lehman system also have potential slippage problems since this device does not grip about the indented portions of a drum body and instead tries to broadly grip about the largest outer diameter dimension when lifting.

Another problem with the single lift mechanism of Lehman is that the arcuate members are not fixably clamped in place during lifting and can separate during a lift causing a dram to fall and become damaged. Further, because the Lehman device must be attached to a forklift, that device is Snot a suitable piece of cargo handling equipment for stevedoring operations. Stevedoring operations require cargo handling equipment be attached to a spreader bar assembly for lifting drums from a cargo wharf to stowing aboard merchant cargo ships and also for later removing the cargo. Thus, devices such as Lehmans cannot work with stevedoring operations.

Thus, there is a need for an improved lift mechanism for lifting storage drums that avoid the problems associated with the prior art lifters referred to above.

SUMMARY OF THE INVENTION

The first objective of the present invention is to provide a drum lifting apparatus that is adjustable to grip about the top side-edge indentations from the bottom side of a metal ring affixed to a drum.

The second object of this invention is to provide a drum lifting apparatus that can be attached to a spreader bar assembly for lifting up to 12 drums or more per lift.

The third object of this invention is to provide a drum lifting apparatus that can safely and efficiently handle conical plastic drums.

The fourth object of this invention is to provide a drum lifting apparatus that can adjust to various diameter sized drums.

The fifth object of this invention is to provide a drum lifting apparatus that can lift and lower drums from above in side-by-side positions where needed without the need for extra space to drive a forklift.

A preferred embodiment includes two square robes that are telescopically inserted within one another whose opposing ends contain vertical supports. The vertical supports each includes clamps on the lower ends for gripping about and within indented edge ridges of a drum to be lifted. A stretched spring pulls the clamps continuously towards one another and a lifting means such as a cable, chain and the like lifts the drums in operation. A lifting arrangement has the one embodiment able to lift and lower an individual drum to side-by-side arrangements with other drums. The drums to be lifted can be plastic conical 55 gallon storage drums or standard metal drums and the like.

Further objects and advantages of this invention will be apparent from the following detailed description of a presently preferred embodiment which is illustrated schematically in the accompanying drawings.

BRIEF DESCRIPTION OF THE FIGURES

FIG. 3 shows a top view of the invention of FIG. 1 in operation lifting 4 drums.

FIG. 4 shows a side view of FIG. 3.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
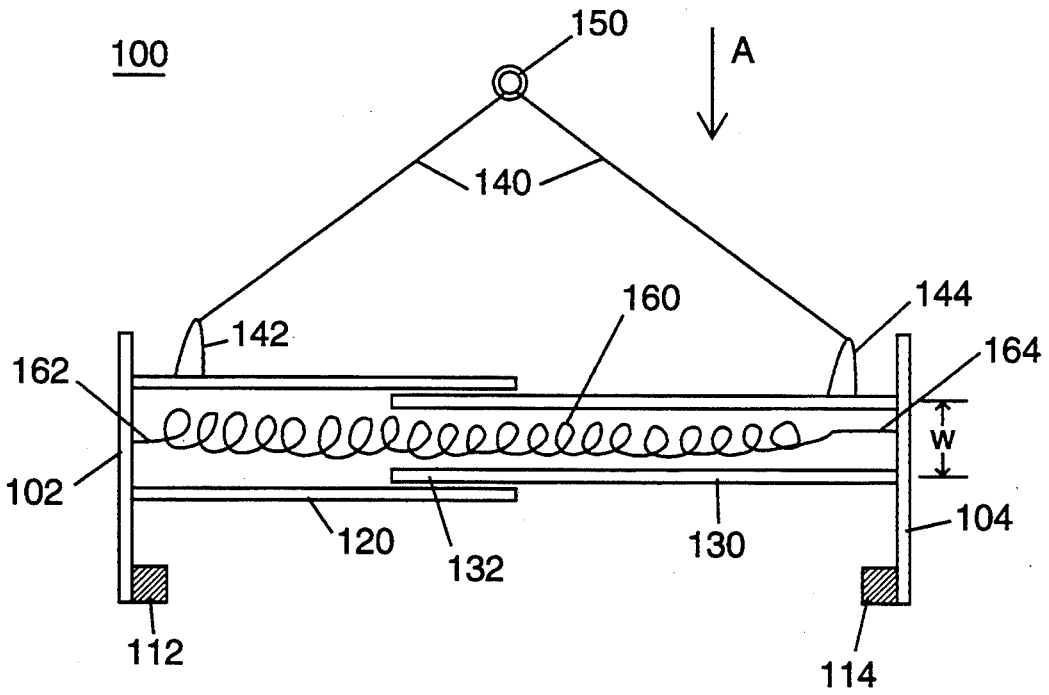
FIG. 1 shows a side exterior view of a telescopic lifting bar invention embodiment.
Figure 2:
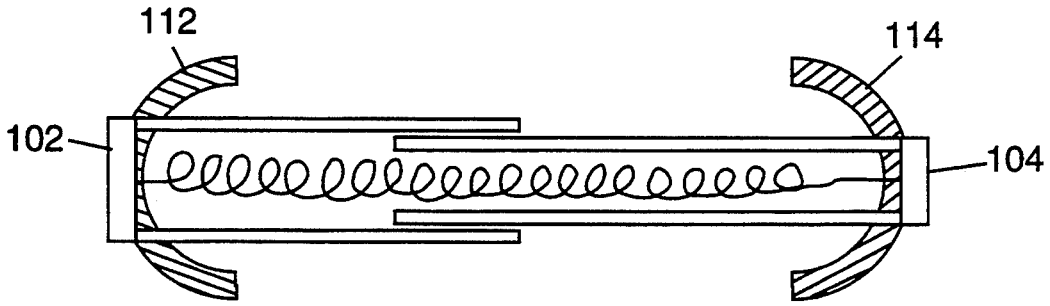
FIG. 2 shows a side view of the invention of FIG. 1 along arrow A.

FIG. 1 shows a side exterior view of telescopic lifting bar 100. FIG. 2 shows a side view of the invention 100 of FIG. 1 along arrow A. The main components are described a follows. Vertical supports 102 and 104 formed of metal, aluminum, steel, stainless steel, and the like, are connected at their bottoms to clamp protrusions 112 and 114 formed of metal, robber and the like, which are used to grip about indentations on the sides of drums near their top ends and below bottom rings 302, 304 which will be described in relation to FIGS. 3 and 4. The length of vertical supports is approximately 8 inches and is variable depending upon the location of the indentation of the drum sides that is to be used. The midportions of vertical supports 102 and 104 connect to telescopic square tubing 120 and 130 having width, W, of approximately $1\frac{1}{2}$ inches for tubing 130 and slightly larger for robing 120, in order for a portion 132 of tubing 130 to be able to telescopically be inserted into and out of tubing 120. Tubing 120 and 130 can be formed from materials such as but not limited to metal, aluminum, steel, stainless steel and the like. A spring 160 has ends 162 and 164 respectively connected to vertical supports 102 and 104. Spring 160 can have nominal tensile strength.

Flexible lifting strands 140 such as cable, chain, steel-metal shackles and the like, can be attached at ends to loops 142 and 144 which are respectively attached to tubes 120 and 130. The longer the length of the lifting strands 140, the greater the inward force given to the indented portion gripped by clamps 112 and 114. A lifting ring 150 such as but not limited to a standard 2 ton steel shackle, can be attached to a conventional lifting machine such as a crane and the like(not shown), in order to be able to lift and lower the attached drums.

In operation, supports 102 and 104 shown in FIG. 2 can be expanded outward away from one another and positioned about indented ridge edge portions 292 and 294 of drums 300 and 301 respectively which is better illustrated in FIG. 4. The drums 300 and 301 can be the plastic 55 gallon conical drums as those described in copending application Ser. No. 08/279,502, which is incorporated by reference to the same inventors thereof. The stretched spring 160 puts a constant compressing lock on holding clamps 112 and 114 in place. Component 340 refers to chain supports as alternative lifting strands that have been discussed previously.

FIG. 3 shows a top view of the invention of FIG. 1 in operation lifting 4 drums. In this application, one telescopic lifting bar 100 is used per dram.

Although, the preferred embodiment has specified that the dram to be lifted can be a conical plastic drum, the invention would have applicability to lifting other types of drums such as but not limited to drums formed from metal, steel, aluminum, fiberglass and the like.

Although the preferred embodiment has described a conical dram having a 55 gallon capacity, other sizes can be used as needed.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A lifting apparatus for vertically raising and lowering a substantially cylindrical drum, the drum having a top edge and an indented area directly beneath the top edge, wherein the drum is aligned side-by-side to an adjacent drum, the apparatus comprising:

a first square tube having a first end and a second end, the first end includes a first clamp having an inwardly protruding arcuate portion that grips about an indentation directly below a top edge of a drum;

a second square tube having a first end and a second end, wherein the first end of the second tube is axially aligned with to be telescopically inserted within the second end of the first tube, and the second end of the second tube includes a second clamp having an inwardly protruding arcuate portion that grips about the indentation directly below the top edge of the drum;

a spring means for pulling the first end of the first tube toward the second end of the second tube causing an inward force between the first and the second clamps;

a flexible strand attached both to the first end of the first tube, and to the second end of the second tube, the flexible strand having a mid-portion which is attached to a hoisting means, wherein lifting the strand by the hoisting means increases the inward force between the first and the second clamps allowing the drum to be stored side-by-side to another vertically positioned drum.

2. The lifting apparatus of claim 1, wherein the lifting strand includes:

a chain.

3. The lifting apparatus of claim 1, wherein the lifting strand includes:

a cable.

4. A device for vertically lifting and lowering 55 gallon plastic storage drums, each drum having a top edge and an indented area directly beneath the top edge, wherein the drum is aligned side-by-side to an adjacent drum, the device comprising:

a first square tube having a first end and a second end;

a first vertical support attached to an extending perpendicular to the first end of the first tube the first vertical support having an inwardly protruding arcuate portion for gripping into an indentation near the top of a drum which is located below an external ring positioned about the circumferential outer edge of the drum;

a second square tube having a first end and a second end, the first end of the second tube is axially aligned with to be telescopically inserted within the second end of the first tube;

a second vertical support attached to and extending perpendicular to the second end of the second tube the second vertical support having an inwardly protruding arcuate portion for gripping into the indentation in the top of the drum located below the external ring positioned about the circumferential outer edge of the drum;

a spring means for pulling the first end of the first tube toward the second end of the second tube causing an inward force between the first and the second vertical supports; and a flexible lifting strand attached to both the first tube and the second tube for lifting the drum, the flexible strand having a mid-portion which is attached to a hoisting means, wherein lifting the strand by the hoisting means increased the inward force between the first and the second vertical supports allowing the drum to be stored side-by-side to another vertically positioned drum.

5. The device for lifting drums of claim 4, wherein the lifting strand includes:

a chain.

6. The device for lifting drums of claim 4, wherein the lifting strand includes:

a cable.

* * * * *